US005306886A

United States Patent [19]

Yamada

[11] Patent Number: 5,306,886

[45] Date of Patent: Apr. 26, 1994

[54] KEYBOARD SWITCH

[75] Inventor: Kazunori Yamada, Tokyo, Japan

[73] Assignee: SMK Co., Ltd., Tokyo, Japan

[21] Appl. No.: 898,451

[22] Filed: Jun. 15, 1992

[51] Int. Cl.[5] ..... H01H 1/10

[52] U.S. Cl. ..... 200/517; 200/345; 200/5 A

[58] Field of Search ..... 200/517, 520, 521, 341, 200/342, 345, 5 A

[56] References Cited

U.S. PATENT DOCUMENTS

| | | | |
|---|---|---|---|
| 4,417,294 | 11/1983 | Herron | 200/517 X |
| 4,515,999 | 5/1985 | Harper | 200/517 X |
| 4,827,243 | 5/1989 | Chang | 200/521 X |
| 4,920,237 | 4/1990 | Eardley et al. | 200/517 X |
| 4,927,990 | 5/1990 | Aoki et al. | 200/517 |
| 5,120,923 | 6/1992 | Kato et al. | 200/517 X |
| 5,145,058 | 9/1992 | Lee | 200/517 |

FOREIGN PATENT DOCUMENTS

| | | | |
|---|---|---|---|
| 2309041 | 9/1973 | Fed. Rep. of Germany | 200/341 |
| 3346296 | 7/1985 | Fed. Rep. of Germany | 200/341 |
| 67423 | 3/1991 | Japan | 200/341 |

*Primary Examiner*—Glenn J. Barrett

*Attorney, Agent, or Firm*—Thomas R. Morrison

[57] ABSTRACT

A keyboard switch has a deformable membrane which, when deformed, enables electrical contact between a pair of contacts. A key stem is urged away from the deformable membrane by an elastic body. When the key stem is displaced sufficiently, the elastic body imparts a click feel. The key stem, when displaced a sufficient amount, deforms the deformable membrane to make the electrical contact.

6 Claims, 3 Drawing Sheets

KEYBOARD SWITCH

BACKGROUND OF THE INVENTION

This invention relates to a keyboard switch and, more particularly, to a keyboard switch having membrane contacts.

A wide variety of switches have been proposed to make keyboards thinner. Japanese Utility Patent Publication No. 12332 of 1980 discloses examples of such switches. As shown in FIG. 4(*a*) and (*b*) of this reference, two fixed contacts of printed wiring sit on an insulating baseplate separated by an insulating spacer from a conductive, elastic sheet whose pipe-shaped portion is within a housing and directly beneath a key top. When the key top is depressed, the pipe-shaped portion is flexed to short out the two fixed contacts, thus closing an electrical circuit.

Japanese Laid-open Utility Model Publication No. 101915 of 1986 also discloses a keyboard switch, which, as shown in FIG. 5., used two fixed contacts on an insulating baseplate beneath a box-shaped housing. An elastic contact member with two moving contacts is mounted at the base of a key stem beneath a key top. Pressing down the key top connects the two fixed contacts and the moving contacts, thereby closing a circuit.

In the key shown in FIG. 5, depressing the key deforms the elastic contact member, collapsing a thin-wall portion thereof to produce a click feel. If the key top is further depressed, the moving contacts touch the fixed contacts 13 to energize a circuit.

This prior art has drawbacks. Regarding the keyboard switch shown in FIG. 4, the continued operation of a keyboard without a click feel causes fatigue. Also, a keyboard with this type of key is bulky, because the insulating spacer must be thick enough to keep the two fixed contacts from contacting the pipe-shaped portion under normal conditions when the key top is not pressed down. Further, since the pipe-shaped portion is formed integrally with the elastic conductive sheet, the mechanism is not flexible enough to be used in some keyboards. Regarding the keyboard switch shown in FIG. 5, although a switch having such a click feel may operate satisfactorily without causing fatigue, the height of elastic contact member is too great to be suitable for a thin keyboard.

OBJECTS AND SUMMARY OF THE INVENTION

An object of the present invention is to provide a keyboard that overcomes the drawbacks of the prior art.

A further object of the present invention is to provide a thin keyboard switch that gives a click feel and allows for a stroke long enough after turning on to minimize user fatigue.

Still a further object of the present invention is to provide a thin keyboard switch with a click feel.

A still further object of the invention is to provide a thin keyboard switch that is easy to assemble.

Briefly stated, the present invention provides a keyboard switch that has a deformable membrane which, when deformed, enables electrical contact between a pair of contacts. A key stem is urged away from the deformable membrane by an elastic body. When the key stem is displaced sufficiently, the elastic body imparts a click feel. The key stem, when displaced a sufficient amount, deforms the deformable membrane to make the electrical contact.

According to an embodiment of the invention, there is provided a keyboard switch comprising: a deformable membrane, means responsive to deformation of said deformable membrane for closing an electrical contact, a key stem, resilient means for urging said key stem away from said deformable membrane, means for permitting manual displacement of said key stem toward said deformable membrane, said resilient means including means for providing a click feel at a first predetermined amount of displacement of said key stem, and means for permitting said key stem to deform said deformable membrane sufficiently to close said electrical contact at a second predetermined amount of displacement of said key stem.

According to a feature of the invention, there is provided a key switch comprising: an insulating baseplate, a spacer on said insulating baseplate, at least one opening in said spacer, a first contact on said insulating baseplate in said at least one opening, a deformable membrane on said spacer covering said at least one opening, a second contact on said deformable membrane facing said first contact, and maintained spaced from said first contact when said deformable membrane remains undeformed, a key stem, means for urging said key stem away from said deformable membrane, means for permitting displacement of said key stem toward said deformable membrane, and means responsive to said key stem being displaced a predetermined amount, for permitting said key stem to deform said deformable membrane a sufficient amount for electrical contact to be established between said first and second contacts.

The keyboard switch of this invention is configured so that an elastic body intervenes between a key top and an insulating baseplate to give a click feel. A slim elastic insulating body consisting of rubber pipe common to key tops separates a key stem and a flexible membrane carrying a movable contact. The movable contact is normally spaced from a fixed contact on the insulating baseplate. When the key top is depressed, the elastic body collapses to give a click feel. Immediately thereafter the slim elastic insulating body is deformed, thereby deforming the flexible membrane to make contact between the movable and fixed contacts. If the key top is further depressed, the elastic body and the slender elastic body further deform to give a long enough stroke after the key is actuated.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 4A:
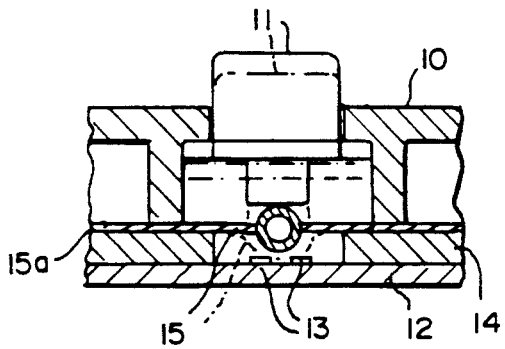
FIG. 4(a) PRIOR ART
FIGS. 4(*a*) and 4(*b*) show cross sectional views of conventional keyboard switches.
Figure 4B:
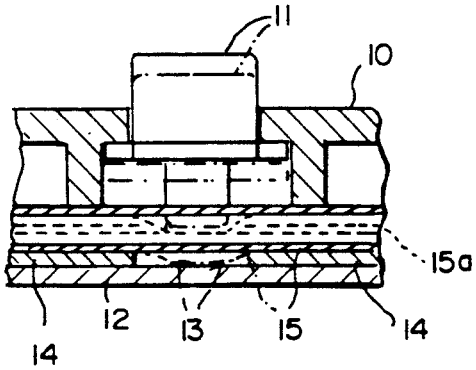
FIG. 4(b) PRIOR ART

Referring to FIGS. 4(*a*) and (*b*), in an example of the prior art, two fixed contacts 13 of printed wiring are disposed on the surface of an insulating baseplate 12. An insulating spacer 14 separates fixed contacts 13 from an elastic conductive sheet 15*a*, above which are arranged a housing 10 and a key top 11. Elastic conductive sheet 15*a* has a pipe-shaped (hollow cylindrical) portion 15. When key top 11 is depressed, pipe-shaped portion 15 is squeezed so that fixed contacts 13 are connected, thereby closing an electrical circuit.

The key elements shown in FIGS. 4(*a*) and 4(*b*) are constructed thin. The advantage of this construction is that pipe-shaped portion 15 of elastic conductive sheet 15*a* is continuous, so that assembly of an entire keyboard made up of such keys is relatively easy. That is, each row of keys shares the same pipe-shaped portion 15.

Figure 3:
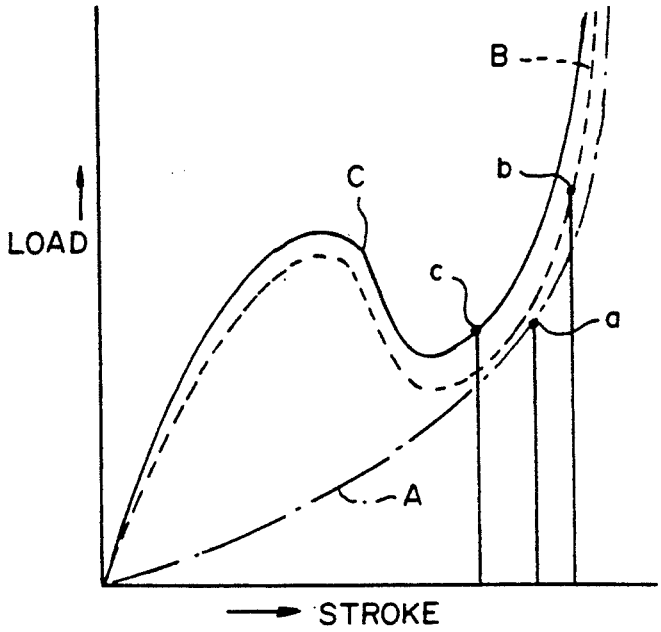
FIG. 3 is a diagram of characteristic curves showing the relationship between the keystroke displacement and the load on the key.

When key top 11 is depressed the load gradually increases in almost direct proportion to the stroke, as shown by the dashed line A in FIG. 3. Thus fixed contacts 13 actuate the key circuit at a point "a" without giving the user any click feel. If key top 11 is further depressed, pipe-shaped portion 15 is completely flattened at the keystroke's final point.

This prior art leads to problems, in that, without the feedback of a click feel, the operator tends to push harder on top key 11 than is necessary for completion of contact, whereby operation for a long time of a keyboard without a click feel causes fatigue. Furthermore, since pipe-shaped portion 15 is formed integrally with elastic conductive sheet 15*a*, insulating spacer 14 must be thick enough to prevent the contact of fixed contacts 13 and pipe-shaped portion 15 under normal conditions when key top 11 is not depressed. Thus the keyboard has to be thick to employ this mechanism of the prior art. Since the position of pipe-shaped portion 15 in relation to elastic conductive sheet 15*a* is fixed, there is no flexibility to apply this mechanism to other keyboards.

Figure 5:
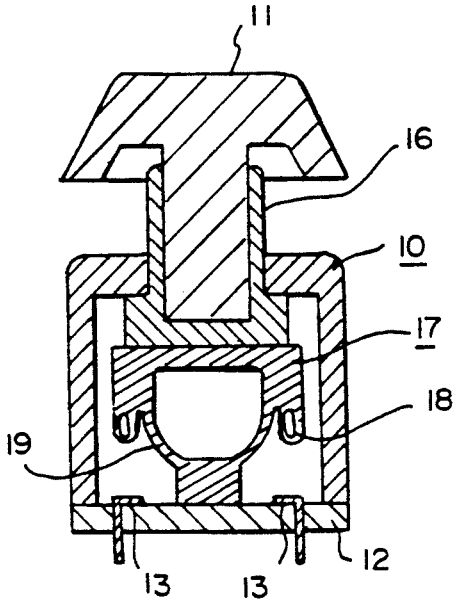
PRIOR ART FIG. 5
FIG. 5 is a cross section of another conventional keyboard switch.
Figure 6:
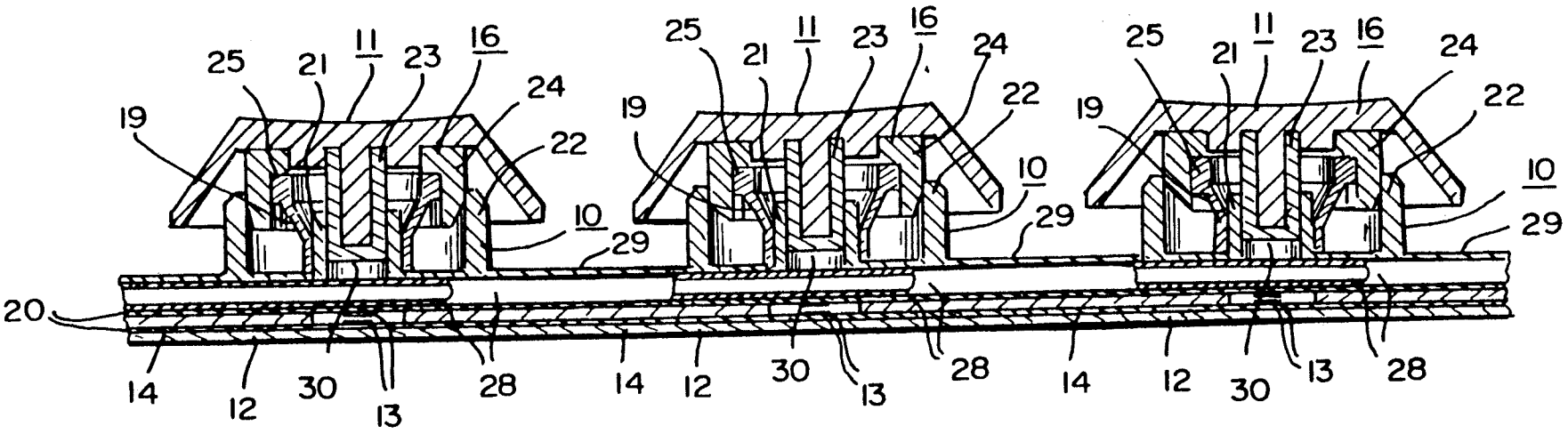
FIG. 6 is a cross section showing a plurality of keyboard switches of FIG. 1.

Referring to FIG. 5, in another prior-art keyboard, two fixed contacts 13 are provided on insulating baseplate 12 at the bottom of box-type housing 10. An elastic contact member 17, with two moving contacts 18, is attached to a key stem 16 at the lower end of key top 11. Depressing key top 11 closes the electrical circuit by connecting fixed contacts 13 via moving contacts 18 and elastic contact member 17.

Depressing key top 11 causes key stem 16 to depress elastic contact member 17. A thin-walled portion 19 of elastic contact member 17 collapses midway in the stroke to produce a click feel, as shown by the dashed line B in FIG. 3. If key top 11 is further depressed, moving contacts 18 touch fixed contacts 13 to actuate the key circuit at a point "b". Though a switch that generates a click feel in this manner operates satisfactorily and causes little fatigue, the greater height of elastic contact member 17 makes such a switch unsuitable for a thin keyboard.

Figure 1:
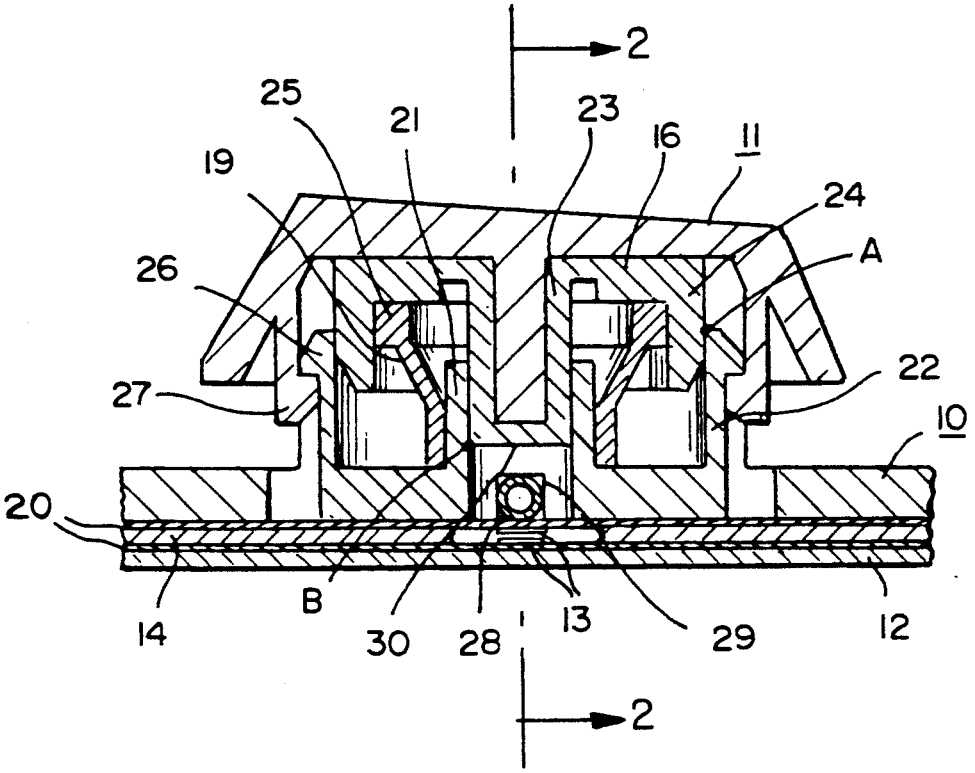
FIG. 1 is a cross section showing an embodiment of the keyboard switch of the present invention.
Figure 2:
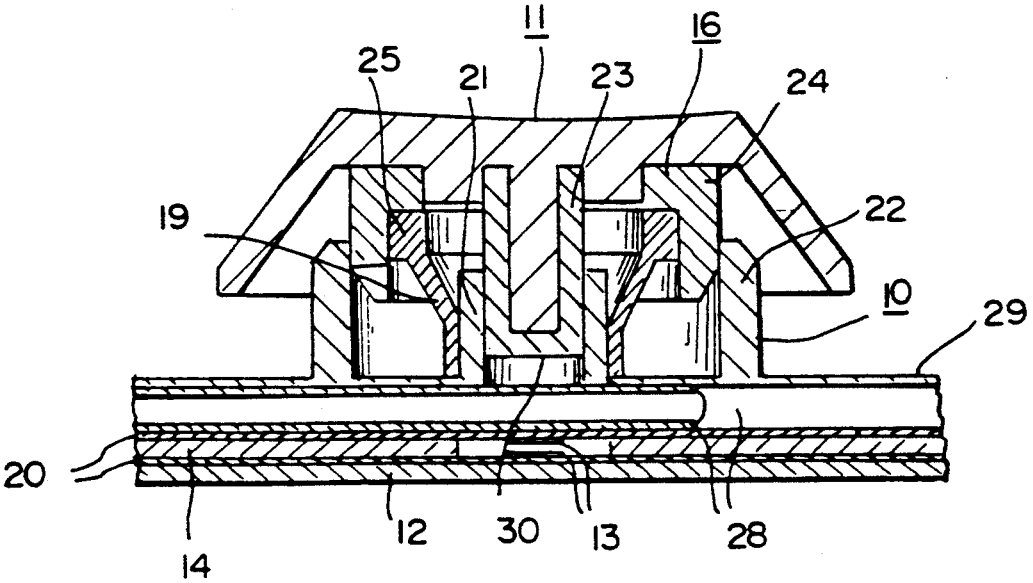
FIG. 2 is a cross section along 2—2 of FIG. 1.

Referring now to the keyboard switch of the present invention, shown in FIGS. 1 and 2, includes a movable contact 13 on a flexible membrane 20 spaced facing a fixed contact 13 on an insulating membrane 20 mounted on an insulating baseplate 12. The two contacts are normally spaced a small distance apart. A key stem 16 deforms flexible membrane 20 to make contact between the two contacts 13 when key top 11 is depressed. An elastic body 25 stands between key top 11 and insulating baseplate 12 to give a click feel. A slim elastic body 28 is disposed between key stem 16 and movable contact 13.

When key top 11 is depressed, elastic body 25 collapses to give a click feel. Immediately thereafter key stem 16 deforms slim elastic body 28 to move the movable and fixed contacts 13 together. If key top 11 is further depressed, elastic body 25 and slim elastic body 28 collapse further to give a longer stroke after the key has been actuated. When the pressure on key top 11 is released, key top 11 is returned to its original position by the rebound of slim elastic body 28 and elastic body 25. This disconnects the moving and fixed contacts 13. A preferred embodiment of this invention is now described with reference to the drawings.

In more detail now, a pair of printed circuit sheets 20 are stacked on the upper face of insulating baseplate 12 and separated by insulating spacer 14. Insulating spacer 14 contains a circular cavity across which printed circuit sheets 20 face each other. A pair of contacts 13, one fixed, and one movable, affixed to respective printed circuit sheets 20, are normally separated by a small space. Housing 10 is disposed above printed circuit sheets 20. Key top 11 is fixed to housing 10 by means of elastic body 25.

On the upper face of housing 10 are mounted a plurality of inner guides 21 for respective keytops 11 at certain intervals that have been built integrally into a vertical cylinder whose central portion passes all through. Provided on the outer circumference of inner guide 21 is an outer guide 22 whose diameter is larger than that of inner guide 21.

Outer guide 22 has a cylindrical wall on its inner circumference and incorporates, at its outer surfaces, a pair of locking portions 26, angularly spaced apart 180 degrees.

A groove 29 on the lower face of housing 10 communicates with the central portion of inner guide 21. Groove 29 is continuous so that it passes through the central portions of many key tops 11 that are in nearly linear arrangement in a single row. Slim elastic body 28, which consists of a rubber tube, rubber string, sponge string, or the like, is inserted into groove 29. Slim elastic body 28 is located between the upper face of movable contact 13 and a contact pressure portion 30 on the lower face of key stem 16.

Key stem 16 is mounted integrally on the lower face of key top 11. An inner slide 23 in a central portion of key stem 16 is slidable up and down within inner guide 21. An outer slide 24 at an outer circumference key stem 16 is slidable up and down within outer guide 22.

The lower circumferential portion of outer slide 24 tapered. The portion A in contact with outer guide 22 at the lower end of outer slide 24 and the portion B in contact with inner guide 21 and contact pressure portion 30 at the lower end of inner slide 23 are formed to have the largest possible path of vertical travel.

Elastic body 25 is fitted into the outer circumference of inner guide 21. Elastic body 25 gradually flares out upward at its thin-walled portion 19. An upper end of thin-walled portion 19 contacts the lower face of key stem 16 with a small gap inside outer slide 24.

Two locking portions 27, integral with the lower face of key top 11, are engagedly fitted into the two locking portions 26.

In the above configuration, when key top 11 is depressed, outer slide 24 of key stem 16 slides along the internal circumference of outer guide 22, while inner slide 23 of key stem 16 slides down along the inner circumference of inner guide 21. Then thin-walled portion 19 of elastic body 25 collapses to give a click feel. If key top 11 is immediately depressed further, contact pressure portion 30 deforms slim elastic body 28, thereby deforming movable contact 13 down into electrical communication with fixed contact 13, thereby actuating the key switch. When key top 11 is depressed still further, elastic body 25 and slim elastic body 28 are further deformed, thereby giving the key a long stroke after it is actuated. When the pressure on key top 11 is released, it regains its original position by the rebound of slim elastic body 28 and elastic body 25.

In the keyboard switch of the present invention, key stem 16 of key top 11 closes contacts 13. Elastic body 25 is inserted between key top 11 and insulating baseplate 12 to give a click feel, with insulating slim elastic body 28 intervening between key stem 16 and fixed contact 13. Thus the keyboard switch, though it is thin, gives a clear click feel. It is excellent in operability and causes no fatigue even after a long period of use.

Because slim elastic body 28 can be much reduced in height, the keyboard may be made thinner than is possible with prior-art devices. Furthermore, because slim elastic body 28 is continuous, serving all the keys in a single row, easy assembly is enabled. Unlike the conventional elastic sheets of the prior art, slim elastic body 28 is narrow and long. It has only to be mounted on printed sheet 20, thereby allowing insulating spacer 14 to be as thin as practicable. Elastic body 28 may be used in keyboards whose contact positions are very different, thereby making it a versatile component.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A keyboard switch comprising:

a deformable membrane;

means responsive to deformation of said membrane for closing an electrical contact;

a key system;

resilient means for urging said key stem away from said deformable membrane;

means for permitting manual displacement of said key stem toward said deformable membrane;

said resilient means including means for providing a click feel at a first predetermined amount of displacement of said key stem; and means for permitting said key stem to deform said deformable membrane sufficiently to close said electrical contact at a second predetermined amount of displacement of said key stem;

said means for permitting said key stem to deform said deformable membrane including an elastic cylinder for absorbing a force of said displacement; and said elastic cylinder is elongate and extends through a plurality of said keyboard switches.

2. Apparatus according to claim 1, wherein said means responsive to deformation includes:

a first electrical contact on a surface of said deformable membrane remote from said key stem; and a second electrical contact facing said first electrical contact, and spaced away therefrom when said deformable membrane remains undeformed.

3. Apparatus according to claim 1, wherein:

said resilient means includes a generally hollow member; and said key stem passes through a center of said generally hollow member.

4. Apparatus according to claim 3, wherein:

said resilient means includes a generally conical portion; and said generally conical portion includes a thin-walled portion effective to impart said click feel.

5. A key switch comprising:

an insulating baseplate;

a spacer on said insulating baseplate;

at least one opening in said spacer;

a first contact on said insulating baseplate in said at least one opening;

a deformable membrane on said spacer covering said at least one opening;

a second contact on said deformable membrane facing said first contact, and maintained spaced from said first contact when said deformable membrane remains undeformed;

a key stem;

means for urging said key stem away from said deformable membrane;

means for permitting displacement of said key stem toward said deformable membrane;

means for deforming said deformable membrane responsive to a depression of said key stem such that an electrical contact is established between said first and second contacts;

said means for deforming including an elastic cylinder for gradual absorption of a force of said depression; and said elastic cylinder is elongate and extends through a plurality of said keyboard switches.

6. Apparatus according to claim 5, further comprising:

said means for urging including an elastic body surrounding said key stem;

said elastic body including a thin-walled portion;

said thin-walled portion being effective for imparting a click feel to said key stem in response to a second predetermined displacement of said key stem.

* * * * *